United States Patent [19]

De Bernardini

[11] Patent Number: 4,761,907

[45] Date of Patent: Aug. 9, 1988

[54] DEVICE FOR THE TRANSFORMATION OF A WEAPON INTENDED TO SHOOT BULLETS INTO A LASER SHOT TRAINING WEAPON

[76] Inventor: Carlo De Bernardini, 8, rue des Maraichers, 1205 Geneve, Switzerland

[21] Appl. No.: 904,498

[22] Filed: Sep. 8, 1986

[30] Foreign Application Priority Data

Sep. 13, 1985 [CH] Switzerland ..... 03983/85

[51] Int. Cl.[4] ..... F41G 3/26

[52] U.S. Cl. ..... 42/106; 42/70.08; 42/103; 434/21

[58] Field of Search ..... 42/103, 106, 70.08, 42/70.01; 434/21; 362/111, 113

[56] References Cited

U.S. PATENT DOCUMENTS

| | | | |
|---|---|---|---|
| 2,826,677 | 3/1958 | Jabanek | 362/111 |
| 3,510,965 | 4/1967 | Rhea | 42/103 |
| 3,633,285 | 3/1970 | Sensney | 42/103 |
| 3,938,262 | 2/1976 | Dye et al. | 42/100 |
| 4,048,489 | 9/1977 | Giannetti | 42/103 |
| 4,141,166 | 2/1979 | Schultz | 42/70.08 |
| 4,313,272 | 2/1982 | Matthews | 42/103 |
| 4,367,516 | 1/1983 | Jacob | 42/103 |
| 4,481,561 | 11/1984 | Lanning | 362/111 |
| 4,501,081 | 2/1985 | Izumi | 42/106 |

*Primary Examiner*—Deborah L. Kyle
*Assistant Examiner*—Michael J. Carone
*Attorney, Agent, or Firm*—Young & Thompson

[57] ABSTRACT

It comprises a shock detector controlling the release of the laser as well as a part 7 limiting the stroke of the percussion system to a value such that its impact on this part will be sufficient to release the laser through the intermediary of the detector but insufficient to cause vibrations of the weapon leading to oscillations of the laser beam.

4 Claims, 1 Drawing Sheet

DEVICE FOR THE TRANSFORMATION OF A WEAPON INTENDED TO SHOOT BULLETS INTO A LASER SHOT TRAINING WEAPON

For highly qualified marksmen, it is necessary to train regularly, even every day, and to fire at each training session a great number of shots. In order to do so, training devices have been designed which comprise a laser which is adapted to be fixed to the gun barrel of the weapon and the ray of which is controlled by the relief of the shot, for example, by a switch controlled by the trigger of the weapon or by means of any other switch.

These devices are however not completely satisfactory since the individual characteristics of the trigger release of the weapon are modified by the actuation of the controlled switch and actual firing conditions are not simulated.

On the other hand, one has tried to use the inpact of the percussion system of the weapon to control the laser ray so as not to modify the characteristics of the trigger release. This approach has not been successful since the vibrations due to the impact at the end of the stroke of the breech or of the percussion member cause such an oscillation of the laser ray that it is impossible to read the position of the shot on the target.

The present invention has for its object a device for transforming a weapon intended to shoot bullets, into a laser training weapon tending to obviate to the precited drawbacks and permitting among other things causing a control of the laser beam by the impact of the breech or of the percussion member, that is to say without modifying the characteristics of the trigger release of the weapon, but still avoiding the creation of oscillations of the laser beam.

This aim is obtained by the device according to the invention which comprises a shot detector controlling the release of the laser as well as a member limiting the stroke of the percussion system to a value such that its impact on this member is sufficient to release the laser through the intermediary of the detector but insufficient to cause vibrations of the weapon leading to oscillations of the laser beam.

The attached drawing shows schematically and by way of example three embodiments of the device according to the invention.

Figure 1:
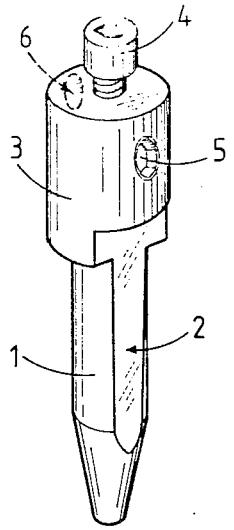
FIG. 1 shows in perspective view the transformation device for a rifle.

The first embodiment of the device shown in FIG. 1 is intended for the transformation of a military gun, this first embodiment comprising a frontal portion 1, the shape of which corresponds to that of a cartridge provided with a cutaway portion in the form of a flat 2 to enable the movement of the ejector. This frontal part is located, in service position in the cartridge chamber of the military gun whereas its rear portion 3 is located in the space provided for the displacement of the breech. This rear portion comprises an axial setting screw 4, the position of which, once set, is fixed by means of a tightening screw 5.

A blind hole 6 enables the introduction of a tool to take the device out of the cartridge chamber of the rifle.

The device comprises further a shock detector, for example, a microphone, placed on the weapon and controlling the release of the laser beam of an optoelectronic device with which the weapon is equipped for training.

When the transformation device is set in place in the cartridge chamber, the user adjusts the position of the screw 4 so that the stroke of the breech will be limited to about 0.6 to 2 mm., that is to say to a value which is sufficient for its impact onto said setting screw 4 to be sufficient to be detected by the shock detector controlling the laser but still sufficiently weak so that it does not cause any oscillation of the laser beam.

The transformation device comprises thus a part 1, 3 limiting the stroke of the percussion device of the weapon, that does not modify the characteristics of the trigger release of this weapon, and a detector controlling the release of the laser beam through the impact at the end of the reduced stroke of the percussion device, of the breech in the example shown here above.

Figure 2:
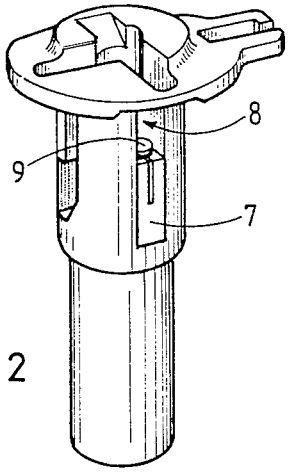
FIG. 2 shows in perspective view a portion of the breech of a conventional gun provided with the transformation device.
Figure 3:
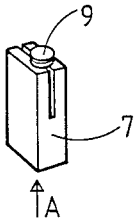
FIG. 3 is a perspective view of the transformation device of FIG. 2.
Figure 4:
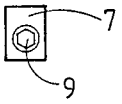
FIG. 4 is a side view in the direction of arrow A of FIG. 3.

The second embodiment of the device shown in FIGS. 2 to 4 enables transforming a conventional rifle into a training laser weapon. Here the device comprises a parallelepipedic part 7 intended to be wedged in the fire groove 8 of the breech which is already present in the rifle, in order to limit the stroke of the percussion member (not shown) during the release of the shot.

This part 7 is slotted on a portion of its length to enable its wedging through elastic deformation into the fire groove 8. This part 7 is pierced by a longitudinal thread in which a setting screw 9 is screwed, the head of which is accessible through the rear of the part 7.

In this embodiment also the position of the setting screw 9 is adjusted once for all, in such a manner that the impact of the percussion member on the screw 9 will be just sufficient to release the laser beam through the intermediary of the shock or acoustical waves detector, but insufficient to create oscillations of the laser beam.

Here again one adjusts the force of the impact of the normal percussion system of the weapon by reducing the stroke of the percussion member to obtain a releasing signal of the laser which is insufficient to cause oscillators of the laser beam.

In the two embodiments described, the device comprises a setting screw since the characteristics of the weapons of a same series are so different so that a standardised reduction of the stroke of the percussion system could not suffice in all cases.

Figure 5:
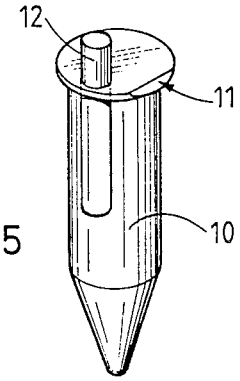
FIG. 5 is a transformation device for a 22 calibre rifle.

The third embodiment shown in FIG. 5 is provided for the transformation of a calibre 22 calibre rifle.

Here on top of the shock detector which is always the same, the device comprises a part 10 having the shape of a cartridge provided with a flat 11 to accommodate the movement of the extractor, intended to be introduced into the cartridge chamber of the rifle. This part 10 comprises a lug 12 extending axially towards the rear located in service position on the path of the percussion member so as to reduce its stroke during the release of the shot. In this embodiment, it is not necessary to provide for an adjustment of the stroke, the inertia of the percussion member of a rifle being small, so that a standard setting is suitable for all the weapons.

Thus in a general way, the transformation device according to the invention consists in a shock detector generally an acoustical one, controlling the release of the laser with which the weapon is equipped for the training, and having an adjustable length or not, limiting the stroke of the percussion system, breech or percussion member, of the weapon to a value such that the impact of this percussion system on this part will be sufficient to cause the release of the laser through said detector but be insufficient to cause vibrations of the weapon leading to oscillations of the laser beam.

I claim:

1. Device for the transformation of a bullet shooting weapon into a laser training weapon, characterized by the fact that it comprises a housing for a shock detector controlling the release of a laser beam as well as a part carried by said housing and limiting the stroke of a percussion system of a said weapon to a value such that the impact of such a percussion system on said device will be sufficient to release such a laser beam through the intermediary of such a detector but will be insufficient to cause vibrations of the weapon leading to oscillations of such laser beam, the housing being parallelepipedic and having dimensions such that it is adapted to be wedged into a fire groove of a breech of a rifle to reduce the stroke of a percussion member of said rifle during the release of the shot.

2. Device according to claim 1, said part being adjustable in position relative to said housing to modify the stroke of the percussion system.

3. Device for the transformation of a bullet shooting weapon into a laser training weapon, characterized by the fact that it comprises a housing for a shock detector controlling the release of a laser beam as well as a part carried by said housing and limiting the stroke of a percussion system of a said weapon to a value such that the impact of such a percussion system on said device will be sufficient to release such a laser beam through the intermediary of such a detector but will be insufficient to cause vibrations of the weapon leading to oscillations of such laser beam, the housing comprising a fore portion having the shape of the cartridge chamber of the weapon, the housing being provided with a cutaway portion which in service position, permits avoiding any interference between the housing and an extractor of the weapon; said part extending within the space in which the displacement of a percussion system of said weapon takes place during the release of the shot.

4. Device according to claim 3, said part being adjustable in position relative to said housing to modify the stroke of the percussion system.

* * * * *